US005797509A

United States Patent [19]

Fitch

[11] Patent Number: 5,797,509

[45] Date of Patent: Aug. 25, 1998

[54] CLOSURE PACKAGE HAVING A CRIMPED LINER PULL TAB AND FORMING METHOD THEREFOR

[75] Inventor: Michael Crim Fitch, Kankakee, Ill.

[73] Assignee: Phoenix Closures, Inc., Naperville, Ill.

[21] Appl. No.: 802,534

[22] Filed: Feb. 18, 1997

[51] Int. Cl.[6] ..... B65D 51/20

[52] U.S. Cl. ..... 220/258; 220/359; 215/232

[58] Field of Search ..... 215/323, 341, 215/347, 349, 254, 255; 220/359, 258, 269, 270; 493/108, 109, 154, 79, 80, 353; 413/3, 9, 59, 63, 64

[56] References Cited

U.S. PATENT DOCUMENTS

| | | | |
|---|---|---|---|
| 3,274,964 | 9/1966 | Griese, Jr. | 413/9 |
| 3,391,847 | 7/1968 | Christine et al. . | |
| 3,501,045 | 3/1970 | Asmus et al. | 220/258 |
| 3,767,076 | 10/1973 | Kennedy . | |
| 3,815,314 | 6/1974 | Pollock et al. . | |
| 3,900,125 | 8/1975 | Wyler et al. . | |
| 3,928,109 | 12/1975 | Pollock et al. . | |
| 3,961,566 | 6/1976 | Westphal et al. | 493/76 |
| 3,973,719 | 8/1976 | Johnson et al. . | |
| 4,020,969 | 5/1977 | Ando . | |
| 4,341,498 | 7/1982 | Ellis | 413/9 X |
| 4,526,562 | 7/1985 | Knudsen et al. | 493/80 |
| 4,637,519 | 1/1987 | Dutt et al. | 215/232 |
| 4,693,390 | 9/1987 | Hekal . | |
| 4,697,719 | 10/1987 | Allen . | |
| 4,754,890 | 7/1988 | Ullman et al. . | |
| 4,767,016 | 8/1988 | Cook, Jr. et al. | 215/232 X |
| 4,771,937 | 9/1988 | Kamada et al. . | |
| 4,778,698 | 10/1988 | Ou-Yang . | |
| 4,784,885 | 11/1988 | Carespodi . | |
| 4,872,571 | 10/1989 | Crecelius et al. . | |
| 4,934,544 | 6/1990 | Han et al. . | |
| 4,954,191 | 9/1990 | Delespaul et al. . | |
| 4,960,216 | 10/1990 | Giles et al. . | |
| 4,981,229 | 1/1991 | Lanham . | |
| 5,004,111 | 4/1991 | McCarthy . | |
| 5,012,946 | 5/1991 | McCarthy . | |
| 5,108,356 | 4/1992 | Rickenbach | 493/353 |
| 5,197,618 | 3/1993 | Goth . | |
| 5,372,268 | 12/1994 | Han | 215/349 X |
| 5,664,694 | 9/1997 | Bietzer et al. | 215/232 X |

FOREIGN PATENT DOCUMENTS

| | | | |
|---|---|---|---|
| 2327161 | 5/1977 | France | 215/232 |

*Primary Examiner*—Allan N. Shoap
*Assistant Examiner*—Nathan Newhouse
*Attorney, Agent, or Firm*—Welsh & Katz, Ltd.

[57] ABSTRACT

A liner for use with a closure package and an associated container includes a pull tab that is crimped so that the tab remains in place during assembly of the closure package. The closure package includes a cap having a top wall portion and a depending skirt portion. The cap has an engaging element formed therein, that is engageable with an engaging portion of the container. The liner is formed of a laminate having a resilient material and an adhesive layer. The liner includes a central portion configured for placement in the cap abutting the top wall portion and a tab extending from the central portion. The tab is folded over so as to rest, at least in part, on the central portion. The tab and central portion define a hinge region which defines a hinge line at a juncture of the tab and the central portion. The hinge region has a deformation area formed therein, in at least two directions relative to the hinge line, to lock the tab in position resting, at least in part, on the central portion. A method of forming the closure package includes cutting a liner material to form a tab and folding the tab onto the material to form a hinge line at a juncture thereof. The liner material is hammered at about the hinge line to form a deformation generally transverse to the hinge line and extending in at least two directions relative to the hinge line. The material is then cut to form the liner central portion with the tab integral therewith. The liner is subsequently positioned in a closure cap.

15 Claims, 2 Drawing Sheets

CLOSURE PACKAGE HAVING A CRIMPED LINER PULL TAB AND FORMING METHOD THEREFOR

FIELD OF THE INVENTION

This invention relates to a closure package having a crimped pull tab liner and a method of making the liner. More particularly, the invention relates to a closure package and liner having a pull tab folded thereover and deformed at the fold to lock the tab in place, and a method of making the liner.

BACKGROUND OF THE INVENTION

Container closures are available in a variety of configurations and constructions. One type of closure includes a threaded cap portion that threadedly engages a complementary thread on a container neck. Another type of closure includes a snap-type cap having a locking bead around a portion of a depending skirt, that engages a complementary locking portion on a container.

In order to provide visibly discernible evidence of tampering, a number of tamper indicating configurations have come into widespread use. In one type of tamper indicating arrangement, the closure cap includes a tamper evident band that depends from the cap skirt portion. The band fractures or separates, either fully or partially, from the skirt portion as the cap is removed from the container to provide tamper indication.

Another arrangement includes a sealing liner positioned between the closure and an upper edge of the container neck. The liner is then sealed, such as by heat sealing, to the edge of the container neck. In this manner, access to the inside of the container is possible only by breaking or removing the liner from the container.

In one known liner arrangement, a pull tab is formed as part of the liner to facilitate removing the liner from the container. The pull tab is a relatively small integral extension of the liner that extends beyond the periphery of the liner that is sealed to the container neck edge. Such pull tabs are well known in the art.

In order to integrate the pull tab with a closure package, e.g., a closure cap, a variety of configurations are in use. In one arrangement, the pull tab is folded over the liner so as to rest within the periphery of the liner, between the liner and the top wall of the cap when the closure cap is placed over the liner, onto the container.

In order to assure that the tab remains flush with the liner material during the manufacturing process, the tab is "hammered" after it is folded to create a hinge or fold. In the hammering process, a flat, hammer-like striker is driven into the tab at about the fold to permanently crease the material. When using relatively thin or permanently deformable material, such as foil, this arrangement is satisfactory to facilitate the tab remaining flush against the liner.

There are, however, a number drawbacks to the hammered tab arrangement. First, when a relatively resilient liner material is used, the tab tends to return to its unstressed state, and unfolds, regardless of the force used to hammer the tab into the folded position. This can be particularly troublesome if the closure forming process is stopped and liners have not yet been positioned inside of their respective closure caps. It has been observed that the tabs tend to unfold and often become caught or jammed on the cap threads or inner lip. When this occurs, the liners do not properly seat within the cap and the cap must be rejected.

Accordingly, there continues to be a need for a resilient liner tab and forming method therefor that sets the fold in the tab hinge and prevents the tab from unfolding during the closure manufacturing process. Such a liner having an integral tab will be formed from relatively commonly used liner materials and will not add appreciably to the cost of the closure cap or require additional steps in the manufacturing process.

SUMMARY OF THE INVENTION

A closure package includes a closure cap and a liner having a crimped pull tab. The liner is configured for use with a container having a finish portion having a sealing surface at an uppermost portion thereof. The closure cap has a top wall portion and a depending skirt portion depending from the top wall portion. The top wall portion is adapted to coact with the container sealing surface to form a seal therebetween. The closure package includes a liner disposed in the cap, positioned intermediate the top wall portion and the container sealing surface when the cap is positioned on the container. The liner has a central portion and a tab portion integral with the central portion, extending outwardly from a periphery thereof. The tab is folded over the central portion into a folded position, and defines a hinge region at the juncture of the tab and the central portion. The hinge region defines a hinge line having a hinge length.

The tab is folded over the central portion to reside within the periphery thereof. The tab and central portion have a deformation area formed therein at about the hinge region, so as to lock the tab into the folded position. The deformation area can extend across only a portion of the hinge line.

In a preferred embodiment, the liner is formed of, in part, a resilient material, such as a closed cell foam. Preferably, the liner material is a laminate formed of the closed cell foam, a gas-impermeable layer, such as a foil, and a heat activated adhesive layer.

In one embodiment, the deformation area has a semi-spherical shape and is formed by a hammer having a striking surface having a semi-spherically shaped head and a complementarily shaped anvil portion. The deformation area is formed generally transverse to the hinge region. The deformation area can extend in at least two directions relative to the hinge region, e.g., downwardly relative to the hinge line and laterally inwardly from the periphery of the liner toward the central region.

A method of forming the crimped liner closure package includes cutting a resilient liner material to form a tab and folding the tab onto the liner material to form a hinge line at a juncture of the tab and the liner material. The liner material and tab are contacted between a rounded hammer striking surface and a complementary anvil surface to form a deformation area at about the hinge line.

The liner material is cut to form the liner central portion with the tab folded onto the central portion, integral therewith. The crimped liner is positioned in the closure cap such that the liner is positioned with the tab intermediate the liner central portion and the top wall portion of the cap. In a preferred method, the deformation area is formed having a semi-spherical shape.

Other features and advantages of the present invention will be apparent from the following detailed description, the accompanying drawings, and the appended claims.

DETAILED DESCRIPTION OF THE PREFERRED EMBODIMENTS

Figure 1:
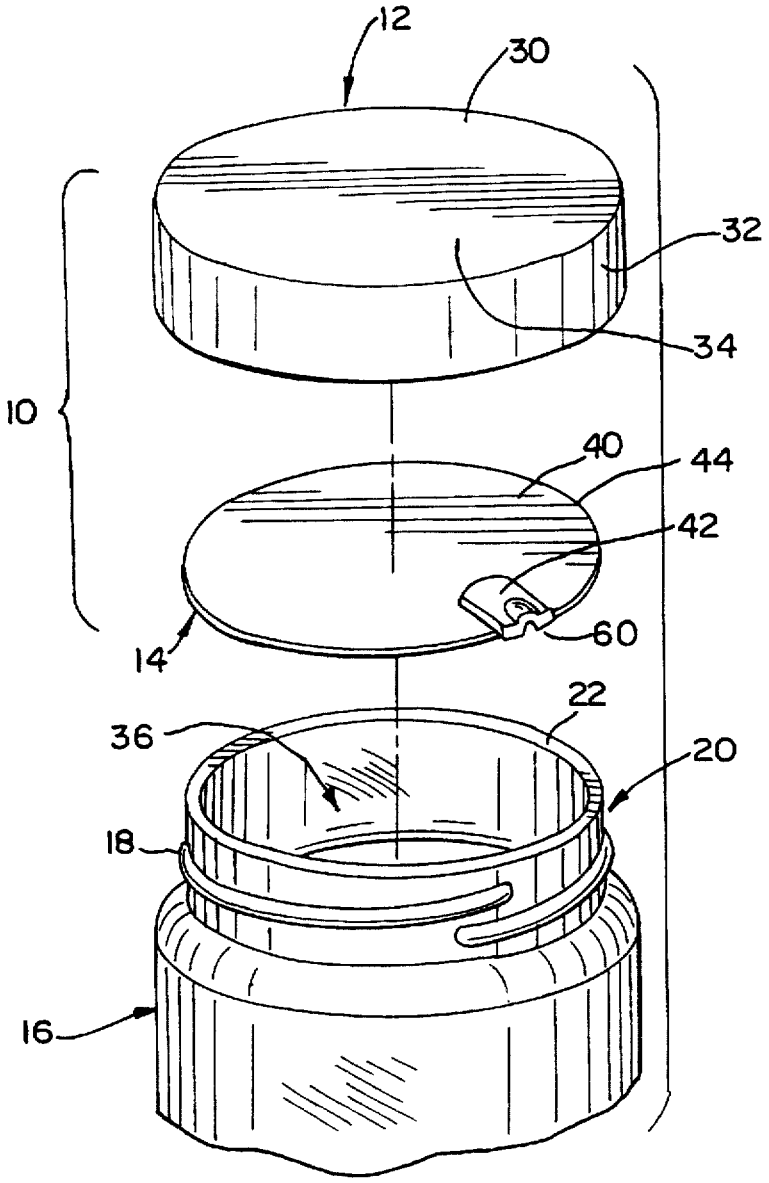
FIG. 1 is an exploded perspective view of a closure package and an associated container, the closure package including a liner having a crimped pull tab embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a closure package 10 including a closure cap 12 and a liner 14 embodying the principles of the present invention. The package 10 is for use with an associated container 16. The exemplary container 16 has a threaded neck portion 18 having a finish 20. The finish 20 is that portion of the container 16 including the upper region which engages the cap 12, e.g., the threaded area 18 and an uppermost sealing surface 22 of the container 16. The container 16 threads 18 engage complementary threads (not shown) formed on an inner surface of the cap 12. It will be recognized by those skilled in the art that the closure package 10 described herein can be used with containers 16 having a snap-like or beaded engagement configuration.

The cap 12 has a top wall portion 30 and a depending skirt portion 32 depending from the top wall portion 30. The inner surface 34 of the top wall portion 30 is adapted to coact with the sealing surface 22 of the container 16 to form a seal therebetween. When the package 10 is assembled, the liner 14 resides between the top wall portion 30 of the cap 12 and the sealing surface 22 of the container 16, spanning the opening or mouth 36 of the container 16.

The liner 14 has a central portion 40 that is positioned over and sealed to the sealing surface 22 of the container 16, and a tab 42 integral with the central portion 40, and extending from a periphery 44 thereof. The tab 42 defines a grasping portion 46, outside of the sealed periphery 44 of the central portion 40, that is adapted to facilitate removing the liner 14 from the container 16.

Figure 4:
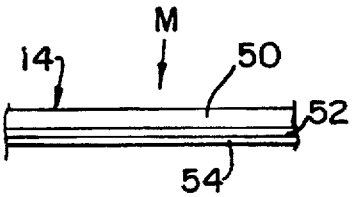
FIG. 4 is a partial cross-sectional view of an exemplary laminate structure of the liner material.

In one embodiment, as illustrated in FIG. 4, the liner 14 is formed from a laminate material M having a resilient substrate layer 50, a foil or like gas-impermeable layer 52, and a heat activated bonding layer 54, such as a heat activated adhesive. In a current embodiment, the resilient substrate layer 50 is a closed cell foam material that is relatively impervious to the environs and establishes an air-tight seal between the container 16 contents and the environs. The resilient material layer 50 permits the cap 12 to be closely fitted to, and tightened onto, the container 16.

Figure 2:
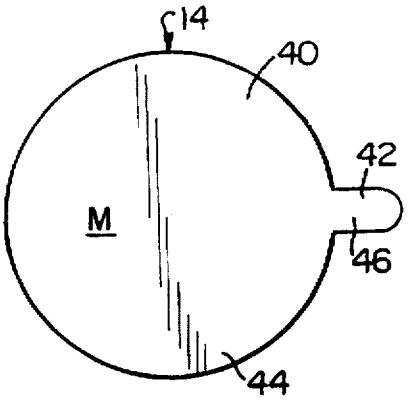
FIG. 2 is top, plan view of a die-cut liner illustrating the liner central portion and the pull tab, with the pull tab being unfolded from the central portion.

During the manufacture of the closure package 10, the stock of liner 14 material M is cut to form the liner 14 tab 42. The tab 42 is folded onto the material M and the tab 42 is "hammered" into place. The liner 14 with the folded and hammered tab 42 are cut to form the liner central portion 40, with the tab 42 integral with the central portion 40. Those skilled in the art will recognize that the die that is used to cut the central portion 40 is configured so that it does not sever the tab 42 from the central portion 40 of the liner 14. Because of the nature of the resilient liner material M, the folded tab 42 tends to unfold, returning to its unstressed state, as illustrated in FIG. 2.

This unfolding phenomena is particularly troublesome when the automated manufacturing process is stopped with closure packages 10 in various stages of completion. In particular, when the tab 42 tends to unfold before the liner 14 is positioned in the cap 12, the tab 42 can become jammed up against the top wall portion 30, or the tab 42 can become caught at the bead or thread of the cap 12. When this occurs, it is highly likely that the liner 14 will not seat properly in the cap 12, and the closure package 10 may not properly seal the container 16. The closure package 10 is then rejected in favor of a package 10 having a properly seated liner 14.

In order to prevent the unfolding phenomena, and the consequent rejection of the closure package 10, the above-noted "hammering" of the tab 42, at about the fold or hinge area or region 56, has been used to create a line-like deformation of the liner 14. As will be recognized by those skilled in the art, creating this line-like deformation facilitates the tab 42 remaining flush with the liner central portion 40. Inasmuch as the material M nevertheless tends to return to its unstressed state, the time over which the material M returns to its unfolded state can be considerably increased by hammering the tab 42.

It has, however, been observed that when the liner 14 includes a relatively resilient material, such as a closed cell foam layer, the nature of the material is such that the tab 42 tends to return to the unstressed, unfolded state rather quickly. As such, known "hammering" techniques have not proven to be effective for such an application.

The present closure package 10 has a liner having a partially hammered hinge 56, extending across only a portion of a hinge line 58. That is, whereas the hinge line has a length L, the hammering of the hinge 56 can be effected over only a portion of the hinge line 58, or over a distance less than L. In a preferred embodiment, the hammering is effected over only a portion of the hinge line 58, centrally thereof.

Figure 3:
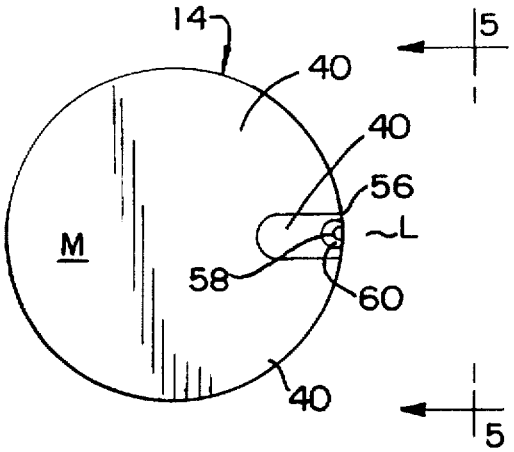
FIG. 3 is a top plan view of the liner if FIG. 2, illustrated with the pull tab folded back onto the central portion and with the tab crimped so as to lock it into the folded position.
Figure 5:
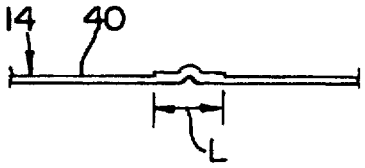
FIG. 5 is a side view of the liner of FIG. 3 as viewed from line 5—5 of FIG. 3, illustrating, in an overstated form, the crimp in the liner and tab.

The partial hammering establishes a deformation area 60 in the material M. As shown in FIG. 3, in one embodiment, the deformation area 60 is formed as a partial dimple having a semi-spherical shape. The semi-spherical shape is formed by impacting the liner 14 with a hammer 66 having a semi-spherically shaped striking surface 68. A side view of the liner 14 is illustrated in FIG. 5, in which the dimple 60 is shown overstated so as to visually illustrate the dimple 60 formation relative to the central portion 40 and the tab 42. It will of course be understood that the dimple 60 can be formed with a hammer 66 having a spherically shaped striking surface 68 which is positioned with about half of the striking surface 68 contacting the central portion 40 and tab 42.

The dimple 60 is formed in the tab 42 and the liner central portion 40 immediately below and adjacent to the tab 42, as shown in FIG. 5, to form complementary depressed areas or depressions in the tab 42 and central portion 40. The complementary depressions lock the tab 42 in the folded position flush to the central portion 40 of the liner 14 such that the tab 42 remains in place after being struck. Advantageously, the locked-in-place tab 42 remains in position, in contact with or sufficiently close to the central portion 40 surface, for a sufficiently long period of time, such that the liner 14 can be positioned in the cap 12 without the tab 42 returning to the unfolded state and interfering with positioning the liner 14 therein.

As can be seen from FIGS. 1, 3 and 5, the deformation area 60 is formed generally transverse to the hinge region 56 and the hinge line 58. In one embodiment, the deformation area 60 extends in at least two directions, e.g., downwardly as shown in FIG. 5 transverse to the plane of the liner 14, and laterally inwardly from the periphery 44, toward the central portion 40, as best seen in FIGS. 1 and 3. The deformation in the tab 42 and the central portion 40 locks the tab 42 in place against, or sufficiently close to, the central portion 40 whereby the tab 42 will not interfere with positioning the liner 14 in the cap 12. In a most preferred embodiment, the deformation area 60 has a semi-spherical shape.

Those skilled in the art will recognize that after placement of the liner 14 in the cap 12 and positioning the cap 12 on the container 16, the liner 14 must still be sealed to the sealing surface 22 of the container 16. Sealing can be effected using a variety of known methods. In one method of sealing the liner 14 to the container 16, the package 10 is subjected to heat, e.g., heat sealing, and the heat sensitive adhesive layer 54 bonds to the sealing surface 22. Thus, the cap 12 can be removed from the container 16 and the liner 14 remains bonded to the container 16. The bonded liner 14 helps to maintain the contents of the container 16 fresh, and provides tamper indication for the package 10.

Figure 6:
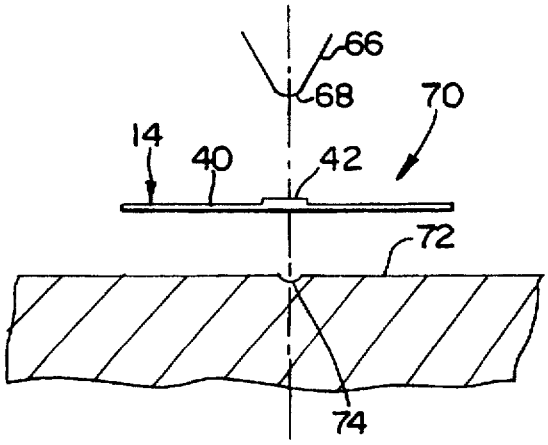
FIG. 6 is an illustration of an apparatus for forming the crimped pull tab and liner.

In one method of forming the package 10, a cutting from a stock of the liner material M is made to form the liner 14 tab 42. The tab 42 is then folded onto the liner 14 material M to form a hinge line 58. The liner 14 material M is positioned in a striking device, such as the exemplary device 70 illustrated in FIG. 6, with the tab 42 portion resting on an anvil portion 72 of the device 70. The material M is stuck with a hammer portion 66 of the device 70.

The hammer portion 66 has a rounded or semi-spherical shaped striking surface 68. The anvil portion 72 has a complementary shape as illustrated at 74 . The striking surface 68 is brought into contact with the liner 14 material M, at about the hinge line 58, as the material M rests on the anvil 72, to form the deformation area 60. It has been found that better tab 42 retention characteristics are exhibited when the liner material M is struck with the hammer striking surface 68 contacting the side of the material M opposite the resilient layer 50, that is, with the tab 42 resting on the anvil portion 72.

The liner 14 material M, having the folded and crimped tab 42 is cut to form the liner central portion 40. Those skilled in the art will recognize that the die that is used to cut the central portion 40 is configured such that it does not sever the tab 42 from the central portion 40. The liner 14, having the tab 42 thereon is subsequently positioned in the closure cap 12 to form the closure package 10. The cap 12 and liner 14 can be placed onto the associated container 16, and the liner 14 sealed to the container 16 by, for example, heat sealing. It will be recognized by those skilled in the art that other methods of sealing the liner 14 to the container 16 can be used to form the tamper-indicating package 10.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A closure package for use with an associated container, the container having a finish portion having a sealing surface at an uppermost portion thereof, the package comprising:

a closure cap having a top wall portion and a depending skirt portion depending from said top wall portion, said top wall portion being adapted to coact with the container sealing surface to form a seal therebetween; and a liner disposed in said cap and positioned intermediate said top wall portion and the sealing surface when said cap is positioned on the container, said liner having a central portion and a tab portion integral with said central portion, said tab extending outwardly from a periphery of said central portion and being folded thereover into a folded position to define a hinge region at a juncture thereof, said hinge region having a hinge length, said tab being folded over said central portion to reside within said periphery thereof, said tab and liner having a deformation area formed that is smaller than and across said hinge region, transverse thereto, so as to lock said tab into said folded position.

2. The closure package in accordance with claim 1 wherein said liner is formed of a resilient material.

3. The closure package in accordance with claim 1 wherein said deformation area has a semi-spherical shape.

4. The closure package in accordance with claim 1 wherein said deformation area extends along a central portion of said hinge line.

5. The closure package in accordance with claim 1 wherein said liner material is a laminate having a resilient material layer and at least one other layer.

6. The liner in accordance with claim 1 wherein said deformation area is a crimp.

7. The closure package in accordance with claim 1 wherein said hinge region defines a hinge line and wherein said deformation area extends in at least two directions generally transverse to said hinge line.

8. The closure package in accordance with claim 7 wherein one of said directions is lateral of said hinge line, inward of said periphery, toward said central region.

9. The closure package in accordance with claim 1 wherein said deformation area extends at least in part inward of said central portion from said periphery.

10. The closure package in accordance with claim 9 wherein said deformation area is at least in part spherically shaped.

11. A liner for use with a closure cap and a container, the cap having a top wall portion and a depending skirt portion having an engaging element formed therein, the container having a finish portion adapted to engage the cap engaging element and having a sealing surface, the liner comprising: a resilient material having an adhesive surface, said liner having a central portion configured for placement in the cap abutting the top wall portion and a tab extending therefrom, said tab being folded over so as to rest, at least in part, on said central portion, and so as to define a hinge line at a juncture of said tab and said central portion, said liner having a deformation area formed that is smaller than and across said hinge line extending generally transverse thereto, to lock said tab in position resting, at least in part, on said central portion.

12. The liner in accordance with claim 11 wherein one of said directions is lateral of said hinge line, inward of said liner periphery, toward said central portion.

13. The liner in accordance with claim 12 wherein said deformation area has a semi-spherical shape.

14. The liner in accordance with claim 11 wherein said deformation area extends across only a portion of said hinge line.

15. The liner in accordance with claim 11 wherein said deformation area is a crimp.

* * * * *